US007953546B1

(12) United States Patent
Wall, III

(10) Patent No.: US 7,953,546 B1
(45) **Date of Patent: *May 31, 2011**

(54) TRAFFIC SURVEILLANCE SYSTEM AND PROCESS

(76) Inventor: Henry H. Wall, III, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/725,617

(22) Filed: Mar. 17, 2010

Related U.S. Application Data

(63) Continuation-in-part of application No. 12/703,455, filed on Feb. 10, 2010, now Pat. No. 7,860,640, which is a continuation-in-part of application No. 11/360,958, filed on Feb. 24, 2006, now Pat. No. 7,689,347.

(60) Provisional application No. 60/659,112, filed on Mar. 8, 2005, provisional application No. 60/659,184, filed on Mar. 8, 2005.

(51) Int. Cl.
*G06G 7/70* (2006.01)

(52) U.S. Cl. ..... 701/117; 340/905; 340/907

(58) Field of Classification Search ..... 701/1, 200, 701/301, 117; 340/933, 906
See application file for complete search history.

(56) References Cited

U.S. PATENT DOCUMENTS

| | | | | |
|---|---|---|---|---|
| 4,370,718 | A | 1/1983 | Chasek | |
| 4,908,615 | A | 3/1990 | Bayraktaroglu | |
| 5,444,442 | A | 8/1995 | Sadakata | |
| 6,317,058 | B1 | 11/2001 | Lemelson | |
| 6,366,219 | B1 | 4/2002 | Hoummady | |
| 6,567,748 | B2 | 5/2003 | Matsuno | |
| 6,633,238 | B2 | 10/2003 | Lemelson | |
| 2001/0043836 | A1 | 11/2001 | Coleman | |
| 2003/0189499 | A1 | 10/2003 | Sticklin | |
| 2004/0145497 | A1 | 7/2004 | Pearson | |
| 2004/0218784 | A1 | 11/2004 | Nichani | |
| 2005/0053274 | A1 | 3/2005 | Mayer | |
| 2006/0095199 | A1 | 5/2006 | Lagassey | |
| 2006/0200307 | A1 | 9/2006 | Riess | |
| 2006/0200312 | A1 | 9/2006 | Osaka | |
| 2006/0227316 | A1 * | 10/2006 | Gatt | 356/5.09 |
| 2007/0171293 | A1 | 7/2007 | Okamoto | |

OTHER PUBLICATIONS

Han, Jun Wei and Lei Guo, A Shape-Based Image Retrieval Method, Journal Abstract, Signal Processing: Image Communication, Feb. 2003, pp. 141-156, vol. 18, issue 2, Amsterdam.

Tsechpenakis, G. et al, A Snake Model for Object Tracking in Natural Sequences, Journal Abstract, Signal Processing: Image Communication, Mar. 2004, pp. 214-239, vol. 19, issue 3, Amsterdam.

* cited by examiner

*Primary Examiner* — Khoi Tran
*Assistant Examiner* — Rodney King
(74) *Attorney, Agent, or Firm* — Buskop Law Group, PC; Wendy Buskop

(57) ABSTRACT

A traffic control system to control passage of objects through of an intersection. The system can include a means for viewing for capturing images having a pixel with sensors for detecting at least four points in the frequency spectrum. The system can include a marker means for determining a location and field of view of the means for viewing. The system can include a computer with algorithms to process images to provide information about objects. Parameters of the objects can be used to for determine a protocol for allowing objects to pass through the intersection. The invention also relates to a process for regulating movement of bodies including: capturing images, comparing captured images to a known image to determine information about bodies, determining a protocol for allowing the bodies to pass through the intersection, and operating a control signal to allow the discrete bodies to pass through the intersection.

16 Claims, 2 Drawing Sheets

TRAFFIC SURVEILLANCE SYSTEM AND PROCESS

CROSS REFERENCE TO RELATED APPLICATIONS

The present application is a continuation-in-part application claiming priority to U.S. patent application Ser. No. 12/703,455 filed on Feb. 10, 2010, the entirety of which is herein incorporated, which in-turn claims priority to U.S. patent application Ser. No. 11/360,958 filed on Feb. 24, 2006, the entirety of which is herein incorporated, and which in-turn claims priority to U.S. Provisional Patent Application Ser. No. 60/659,112 filed on Mar. 8, 2005 and U.S. Provisional Patent Application Ser. No. 60/659,184 filed on Mar. 8, 2005, the entireties of which are herein incorporated.

FIELD

The present embodiments generally relate to a traffic surveillance system and process, and more particularly to a traffic surveillance system and process having a marker means and a means for viewing having a plurality of sensors for detecting at least four points in the frequency spectrum. The embodiments further relate to an apparatus or system and method or process for controlling the movement of one or more objects as they approach a point at which the objects are likely to collide if a control apparatus or system is absent.

BACKGROUND

A need exists for a traffic surveillance system and process having a means for viewing having a plurality of sensors for detecting at least four points in the frequency spectrum.

A further need exists for an improved system and process for traffic regulation and control to provide a smooth flow of traffic.

A need exists for a system and process for controlling traffic at intersections without overly complicating a digital camera input device with the total image which the camera can observe and capture as images.

A need exists for a system and process that can use a digital camera to avoid the step of converting images captured into digital format for processing.

A need exists for a system and process that combines a digital camera with a roadside marker and a central processing unit having a computer program which obtains the digital image, processes and analyzes less than the entire image for information on the traffic and then proceeds through a logical progression to produce an output which changes the traffic signal light in a safe and efficient manner so that energy and emotion are conserved.

The present embodiments meet these needs.

BRIEF DESCRIPTION OF THE DRAWINGS

The detailed description will be better understood in conjunction with the accompanying drawings as follows.

Figure 1:
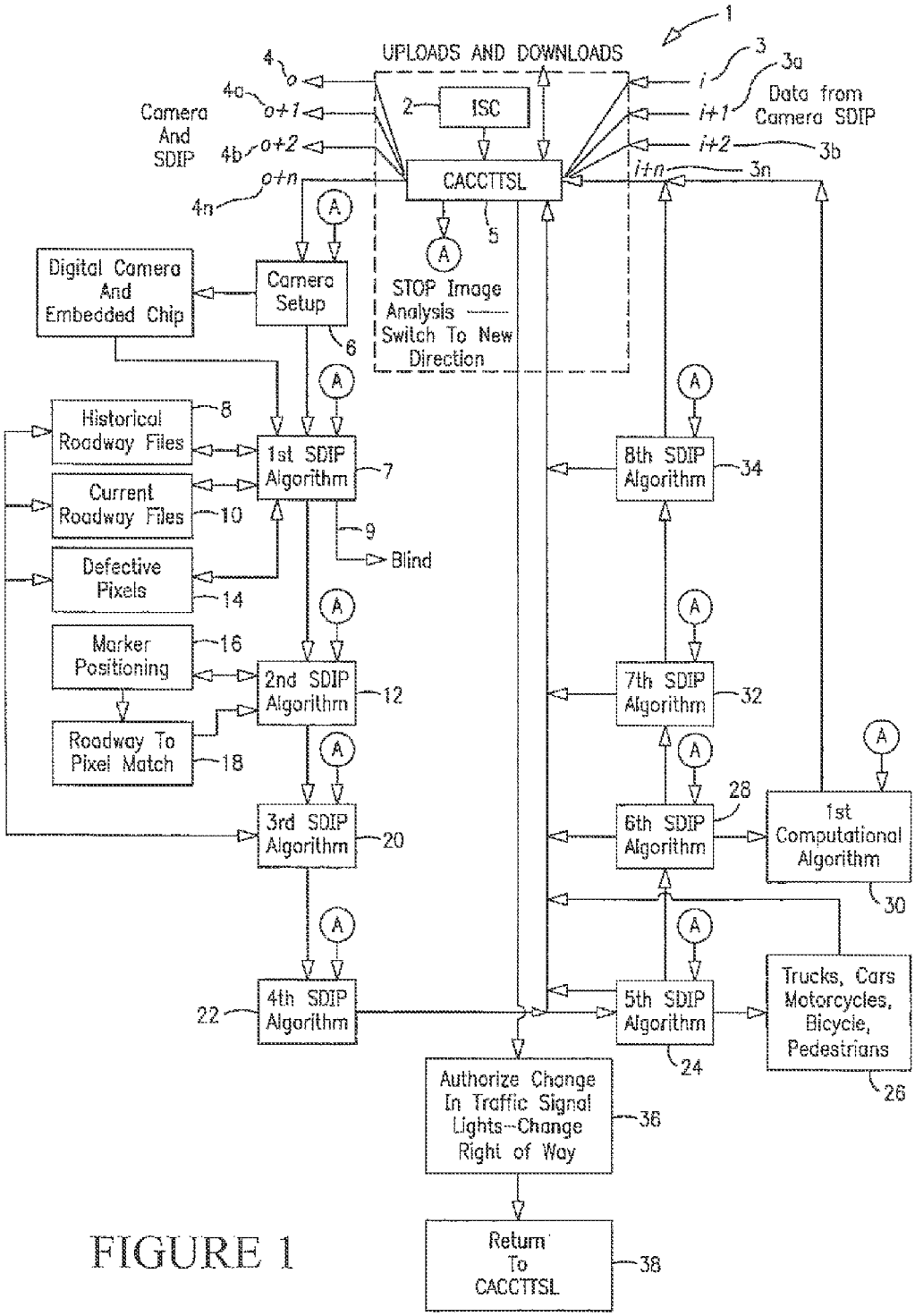
FIG. 1 is a logic diagram of the process for traffic control.

The present embodiments are detailed below with reference to the listed Figures.

DETAILED DESCRIPTION OF THE EMBODIMENTS

Before explaining the present system and process in detail, it is to be understood that the system and process are not limited to the particular embodiments and that they can be practiced or carried out in various ways.

The present embodiments relate to a system or apparatus for preventing the collision of moving objects or for regulating the movement of moving objects through an intersection where at least a first moving object must cross an intersection with another lane having a second moving object therein which is moving toward the intersection.

One or more embodiments can also include a process or method for the regulation of moving bodies on a collision course through an intersection. The embodiments can have use in the industries related to automatic warehousing logistics, biomedical and biomechanical areas, micro-manufacturing, space physics, traffic control and the like.

Although aspects of the present invention are operable in 3-dimensions, for the purposes of explanation and description, there is described the use of the instant invention in a 2-dimensional plane, such as, for purposes of illustration only and without limitation, the intersection of at least two roadways which are regulated and controlled by a tri-color traffic light.

One or more embodiments can include a traffic control apparatus or system adjacent at least two roadways in which one or more moving objects is to be controlled for efficiency and safety in a passage through an intersection of the at least two roadways in real-time.

The system or apparatus can include at least one means for viewing the intersection, at least two roadways, or combinations thereof, and for capturing a series of images thereof to provide information related to movement of one or more of the objects through the intersection, the at least two roadways, or combinations thereof.

The means for viewing can be a high resolution digital camera with four or more optical sensors per pixel for acquiring data related to at least four points on the frequency spectrum including UV, visible, and IR. For example, the means for viewing can have a plurality of pixels with four optical sensors per pixel for acquiring data related to at least four points on the frequency spectrum.

The high resolution digital camera can be a video camera. The high resolution digital camera can pan 360 degrees horizontally, 180 degrees vertically and can zoom from 1 to about 10 times with automatic focus.

The means for viewing the intersection can include a plurality of sensors for detecting at least four points of the frequency spectrum including UV, visible, and IR. Accordingly, each pixel of each image of the series of images can include the at least four points of the frequency spectrum.

The four or more points of the frequency spectrum can include ultra violate, infrared, red, blue, green, panchromatic, cyan, purple, yellow, and orange, as well as arbitrary frequencies chosen in the place of standard colors. Each pixel can contain sensors for each point on the frequency spectrum. For example, the four points on the frequency spectrum can be infrared, blue, green, and red.

In one or more embodiments, the means for viewing can include a plurality of pixels, and each pixel can include a first point on the frequency spectrum, a second point on the frequency spectrum, a third point on the frequency spectrum, and a fourth point on the frequency spectrum. Each pixel can include a first plurality of sensors for detecting the first point on the frequency spectrum, a second plurality of sensors for detecting the second point on the frequency spectrum, a third plurality of sensors for detecting the third point on the frequency spectrum, and a fourth plurality of sensors for detecting the fourth point on the frequency spectrum.

The system or apparatus can also have a marker means at a predetermined location. The marker means can be used to determine the location of the field of view of the means for viewing. The marker means can be a flat, geometrically shaped marker of a fixed and precise geometry for recognition by the computer instructions with algorithms. The marker can have a highly reflective surface, can be sized to be readily recognized by the means for viewing, and can be capable of being viewed at night.

The system or apparatus can also include at least one digital computer means with at least one central processing unit. The at least one digital computer means can employ a simplified digital image processing algorithm to process less than the entire image of each of the images captured in the series of images in order to provide data to a logical algorithm for regulation of passage of one or more of the objects through the intersection.

The central processing unit can include computer instructions with algorithms to process less than the entire image of each image of the series of images and to compare less than the entire image of each image of the series of images to a previously captured image of the intersection.

The previously captured image of the intersection, the at least two roadways, or combinations thereof can include one or more pixels having at least four points of the frequency spectrum. Furthermore, the previously captured image can be an image of the intersection, the at least two roadways, or combinations thereof when it is unoccupied. Accordingly, the previously captured image can be compared to a portion of each image of the series of images to determine and evaluate the information and to provide location, speed, direction of travel, size and distance of an object from the intersection.

The system or apparatus can also have parameters for one or more of the objects in order to provide the parameters as data for computer program instructions for determining the most efficient and effective protocol for allowing each moving object to enter and safely pass through the intersection for regulation of the passage through the intersection.

The system or apparatus can also include one or more algorithms or computer instructions to provide an appropriate control signal. The at least one control signal means can be a tri-color traffic control signal.

The algorithms can include a first algorithm for determining atmospheric conditions for determining blindness of the means for viewing.

The algorithms can include a second algorithm for determining the position of the means for viewing.

The algorithms can include a third algorithm for selecting the previously captured image for comparison with less than the entire image of each image of the series of images.

The algorithms can include a fourth algorithm for selecting atypical pixels for comparison to the previously captured image and for detecting moving objects.

The algorithms can include a fifth algorithm for identifying the atypical pixels by comparing the atypical pixels to memory files on the moving objects stored on the at least one digital computer means.

The algorithms can include a sixth algorithm for calculating the distance of the moving objects from the intersection.

The algorithms can include a computational algorithm for calculating the speed of the moving objects and for calculating the estimated time of arrival of the moving objects to the intersection.

The algorithms can include a seventh algorithm for determining a distance along each roadway for the means for viewing to capture images.

The algorithms can include an eighth algorithm for calculating an expected new location of the moving objects.

Comparisons of the images of the series of images to previously captured images can be performed on a pixel-by-pixel basis.

The system or apparatus can also include a plurality of inputs in communication with each central processing unit for receiving data from the algorithms and a plurality of outputs in communication with the central processing unit for sending instructions to the means for viewing.

The system or apparatus can also include computer instructions for communicating the appropriate control signal to at least one control signal means for regulating the passage of one or more of the objects through the intersection.

The system or apparatus can be used to perform a process for regulating the movement of one or more discrete bodies in motion in specific intersecting lanes and intersecting motion in real-time so that collision of such bodies in the intersection is avoided and the bodies proceed through the intersection in a safe and efficient manner.

In one or more embodiments, the process can include using a camera means having a plurality of sensors for detecting at least four points on the frequency spectrum for each pixel to capture at least a portion of each image of a series of images of the discrete bodies approaching the intersectional area over a discrete period of time.

The process can also include using a known marker means at a predetermined location in at least a portion of each image of the series of images for determining the location of the field of view of the camera means. The camera means can be in communication with at least one central processing unit of at least one digital computer means to provide information related to the movement of one or more of the discrete bodies.

The process can also include using computer instructions which can be stored on the central processing unit. The computer instructions can include a plurality of algorithms to compare each captured image of the series of images using less than the entire image to a known image of an unoccupied lane in order to determine the size, location, speed of approach to, distance from the intersection and direction of travel of at least one such discrete body in the captured image, if any. The known image can include at least four points on the frequency spectrum. Comparisons of the images of the series of images to known images can be performed on a pixel-by-pixel basis.

The plurality of algorithms can be selected from the group of the following: a first algorithm for determining atmospheric conditions for determining blindness of the camera means; a second algorithm for determining the position of the camera means; a third algorithm for selecting the known image for comparison with less than the entire image of each captured image; a fourth algorithm for selecting atypical pixels for comparison to the known image and for detecting discrete bodies; a fifth algorithm for identifying atypical pixels by comparing the atypical pixels to memory files on the discrete bodies stored on the at least one digital computer means; a sixth algorithm for calculating the distance of the discrete bodies from the intersection; a computational algorithm for calculating the speed of the discrete bodies and for estimating the time of arrival of the discrete bodies to the intersection; a seventh algorithm for determining a distance along each intersecting lane for the camera means to capture images; an eighth algorithm for calculating an expected new location of the discrete bodies; or combinations thereof.

A plurality of inputs in communication with each of the at least one central processing units can be used to receive data from the plurality of algorithms and a plurality of outputs in communication with each central processing unit for sending signals to the camera means.

The process can also include determining the most effective protocol for allowing at least one discrete body to enter and safely pass through the intersection based on the calculated size, location, speed, distance from the intersection and direction of travel of at least one discrete body or object. The protocol can be determined using computer instructions on at least one central processing unit.

The process can also include using computer instructions on at least one central processing unit to signal a control means to operate in a safe and efficient process for allowing one or more of the discrete bodies to pass through the intersection.

The system and process can further include using a fail safe intersectional area protocol in the event that a useable image or series of images cannot be captured. For example, the fail safe intersectional area protocol can be initiated when there is no signal from the camera, the camera is judged to be "blinded", or when no match with the roadway can be found.

The process can also include an operator intervening in the process to manually control the intersectional control means.

The process can further include using separate computational devices for each algorithm or subroutine so that simultaneous parallel processing of all simplified digital image processing and computations can be carried out, allowing traffic control in real time.

The system and process can further include a library of defective pixels maintained on the digital computer means. The defective pixels can be pixels that have become non-responsive to light. The defective pixels can be excluded from use by the computer instructions with algorithms.

Turning now to the figures, FIG. 1 depicts a logic diagram for a traffic control signal computer program usable with the marker means. In addition to normal operating system software, such as input/output, communication and calculation features, the central processing unit or controller processor employed in the present invention can include a program. The program can be comprised of several sub-programs or algorithms for specific functions as described hereinafter and several SDIP Algorithms for analyzing less than entire image or for pixel-by-pixel processing.

As shown in FIG. 1, the CACCTTSL logic diagram provides a central processing unit or CPU 1 that allows an input signal from an outside source, such as an installer supervisory control (ISC) computer 2 from an initial installers computer, a centralized traffic control computer, or from a network of intersections overall control computer. Also, inputs i, i+1, i+2, i+n, which are 3, 3*a*, 3*b*, 3*n*, respectively, from the SDIP algorithms can be installed into the CACCTTSL program 5, while outputs o, o+1, o+2, o+n, which are 4, 4*a*, 4*b*, 4*n*, respectively, can be sent with instructions for a change in position of the means for viewing or a request for data from various SDIP algorithms.

The data or information can be received by the CPU 1 from the means for viewing and can be input to the main evaluation and analysis program of SDIP algorithms. The CACCTTSL program 5 can initiate the analysis and evaluation by giving instructions to the means for viewing to set up module 6, which can control the means for viewing position and can provide for pan, tilt or zoom movement of the means for viewing to allow for better viewing of a particular zone or area of interest in or around an intersection.

The First SDIP Algorithm 7 can establish from the data provided by the means for viewing or camera whether some atmospheric condition has blinded the observation by comparison with a library of roadway files 8 maintained within the controller data storage. The roadway files 8 can be maintained in the controller data storage to represent empty road pixel values for each point of each lane of each roadway filed according to time of day, day of year, year and weather conditions, such as dry, wet, flooded, iced, snow-covered or the like.

Where no vehicle is detected, a second file can be set up for the same time, day, year and weather condition as a variant of the roadway files 8. This variant of the roadway files can be stored in current roadway files 10. If the current roadway file 10 data is identical, or within limits, to the same roadway condition already stored in the roadway files 8, the current roadway file 10 can be discarded.

In the event that a sample of the pixels in the data show a "sameness", that is the pixels are essentially the same, then a wider sampling of pixels can be triggered. In the event that this "sameness" of the pixels can be confirmed, then the conclusion is reached that the means for viewing is blind and a blind output signal 9 can be sent to the traffic control signal means. The traffic control means can then revert to a standard protocol for granting right of way or the green light to a roadway in the intersection and the CACCTTSL program logic can revert to another iteration of pixel sampling until a non-blind condition is detected.

When the First SDIP Algorithm 7 encounters a sampling of pixels that are different, and the pixels do not represent a "sameness" of light condition, then a comparison of roadway files 10 can be conducted and differences can be sent to the Second SDIP Algorithm 12. The library of defective pixels 14 can be consulted via a subroutine to determine whether a particular pixel has become non-responsive to light in order to maintain a list of defective pixels so that these can be excluded during simplified image processing.

The Second SDIP Algorithm 12 can establish or calibrate accurately the position of the means for viewing. The Second SDIP Algorithm 12 can determine the means for viewing position in order to avoid errors from movement caused by wind or vibration as a result of traffic or nearby activity. Even though the means for viewing is not necessarily moved between image or partial image capture, for instance, between images captured which are spaced one second apart, movement of the means for viewing can be taken into account during image processing. Furthermore, when the means for viewing is repositioned to a different roadway, calibration can be conducted.

As indicated previously, the means for viewing position can be established by reference to a distinct marker means installed at a known location in or around the intersection, as initially input during installation setup, initializing or maintenance. The size, distance, location and design allow Second SDIP Algorithm 12 to search for a marker means and identify it by using a marker means positioning subroutine 16. When the Second SDIP Algorithm 12 detects a match with a particular marker from the marker positioning subroutine 16, then the means for viewing direction can be known and the roadway can be identified.

These pixels in the known roadway can then be stored in a roadway-to-pixel match file 18. The matching or identification data can be provided to allow the Third SDIP Algorithm 20 to select the appropriate clear or empty roadway condition from roadway files 8 or current roadway files 10. The matching or identification data can be compared to the selected pixel data from the Fourth SDIP Algorithm 22, which can have the objective of finding a vehicle on the roadway.

As the installed data can establish the position of each lane from the intersection to as much as 2000 feet from the intersection, the Fourth SDIP Algorithm 22 can search the pixels along the lanes in the same direction from the intersection, selecting pixels which are spaced apart sufficiently to nevertheless detect motorcycles, small cars and the like. The sampled pixels, which can be less than the total number of pixels that form the captured images, can be compared to the empty roadway files 10. If there is not a match, the permanent files in the historical roadway files 8 can be searched.

Again if there is not a match, the atypical pixels can be selected as focal points for the search for vehicles or other objects in the lanes of interest. In addition, the CACCTTSL program 5 can be notified of these focal point pixels as part of an early notice and continual update feature of the procedure used by the system and process.

The atypical pixel locations can be provided to the Fifth SDIP Algorithm 24 to start a search for one or more vehicles. On a pixel-by-pixel search, the form of a vehicle can be filled in and compared to files of motor vehicles, such as trucks, cars, motorcycles, bicycles and pedestrians maintained in vehicle files 26. The size and shape can be compared to the memory files for a match or close approximation.

To match the size or shape of, for example, a vehicle, the image processing can take into account the height of the means for viewing, the angle at which viewing occurs and the distance away from the means for viewing because these and other factors can influence the target vehicle's aspect and thus alter the shape with which a match can be made. In other words, some compensation can be made for the comparison to the memory file. If the target vehicle (pixels) is too long, it can be considered by the Fifth SDIP Algorithm 24 to be a line of vehicles travelling at the same speed. The CACCTTSL program 5 can be notified about the results as part of the early notification and continual update feature of the overall system procedure.

The information or data can be provided to the Sixth SDIP Algorithm 28 which can calculate the distance of the vehicle (s) from the intersection using simple triangulation calculations, speed, the height of the means for viewing above the roadway, the direction in which the means for viewing is pointing, and the elevation of the lanes as a function of distance from the intersection, and the lowest point of the vehicle (s) as one corner of the triangle. Various points on the vehicle (s) can be used for the calculation, e.g., the front bumper, front tire, the shadow on the ground, or the headlight at night, since the variation of the reference point on the vehicle introduces only very small error into the calculations. The CACCTTSL program 5 can be notified of the distance as part of the early notification and continual update feature of the overall system procedure.

First computational algorithm 30 can use consecutive results from the Sixth SDIP Algorithm 28 at a spacing of about 1 second for the calculation of the speed of the vehicle (s) and of the estimated time at which the intersection can be reached. The CACCTTSL program 5 can be notified of the results.

The Seventh SDIP Algorithm 32 can gather images of all lanes, including turn lanes, at the intersection according to instructions from the CACCTTSL program 5 and can instruct how far to search along each lane. Information from the Fifth SDIP Algorithm 24 can be used to determine the images based on atypical pixels provided by the Seventh SDIP Algorithm 32.

After the vehicle(s) have been located, identified and the speed has been determined, the Eighth SDIP Algorithm 34 can be used to calculate the expected new location of the vehicle(s) and can look for the vehicles(s) in data supplied from the means for viewing. Once verified, an output of the new distance, speed, and expected time of arrival at the intersection can be notified to the CACCTTSL program 5. With this new data, the CACCTTSL program 5 can then run its logical protocol to determine whether to maintain the right of way currently shown on the traffic control signal light or when to stage the light for granting the right of way to another lane or to a turn lane.

The CACCTTSL program 5 can determine when to stop analyzing a specific direction or lane of traffic on a roadway or what data are required. The CACCTTSL program 5 can use the inputs to the various algorithms and to the means for viewing via the stop/change input labeled "A" in FIG. 1. The CCACCTTSL program 5 can then instruct the imaging and evaluation and analysis system to begin in a different direction or of the intersection itself.

As indicated, the overall logic of the traffic control program can be handled by the CACCTTSL program 5 based on SDIP evaluation and analysis. The logical proposition can be hierarchical in nature and can consider at least five cases discussed below.

CASE 1: Right of Way Lanes are Empty. In this case SDIP algorithms have determined that the lanes of the roadway having the green light or right of way are empty. Thus, the right of way can be changed to those lanes having vehicles waiting or approaching within about 20 seconds to 30 seconds.

CASE 2: Right of Way Lanes Have Traffic Which is Not Moving. In this case, the SDIP algorithms have determined that lanes with the right of way have vehicles in them, but the traffic is not moving. The program can check to determine that vehicle(s) in the right of way lane have cleared the intersection before considering whether to return the right of way. Also, the program can determine whether the stopped vehicles are being by-passed; thus, allowing continuation of the right of way. Otherwise, the right of way can be changed to another lane of the roadway.

CASE 3: Right of Way Lanes are Full and Moving. In this case, the right of way can be maintained until priority of traffic guidelines is exceeded. Before the right of way is changed, a calculation can be done to determine the cost of kinetic energy, as skilled persons in the art would know how to accomplish, and compare to the guidelines for priority.

CASE 4: Right of Way Lanes Have Traffic but Have a Gap. In this case, the program can note that a space between approaching vehicles, a "gap", is approaching the intersection. A calculation of the kinetic energy to be lost if the gap is not used to change the right of way can be compared to guidelines to determine if the cost is too great. If so, a change in right of way can be indicated. Otherwise, the change can be delayed until priority times are exceeded.

CASE 5: Right of Way Lanes Have Traffic with an End. In this case, the SDIP algorithms have detected that a line of traffic with the right of way has an end. Before the end arrives at the intersection, if priority time is exceeded, the CACCTTSL program 5 can change the right of way. If on the other hand the end arrives at the intersection and the priority time is not exceeded, the program can change the right of way after the end of the traffic line has passed the intersection.

Based on the data provided by the means for viewing, the evaluation and analysis of the SDIP algorithms and the logical resolution of the hierarchical cases of the CACCTTSL program 5, a determination to change the right of way can be reached and a signal can be sent to authorize a change in the traffic signal module 36. The appropriate instruction can be sent to a traffic control signal unit.

The authorized change in the traffic signal module 36 can notify the return to CACCTTSL module 38 and a signal can be given to the CACCTTSL program 5 that the change in right of way has been completed. The CACCTTSL program 5 can stop image processing in the SDIP algorithms and can instruct the means for viewing to reposition, and the process can begin again.

Although the integrated central processing unit 1 can contain the CACCTTSL program 5 and can handle supervisory control and active image processing and initiation of changes in the timing of traffic control signal lights, an operator using the installer supervisory control computer 2 can override the CACCTTSL program 5. This can be done by using either direct plug-in hardwire connection at the intersection, hardwire or wireless connection to a central traffic dispatch center or wireless or hard wire plug-in connection from a laptop computer.

Such intervention can allow modification of traffic flow or control guidelines, i.e., the normal or default traffic signal timing protocol, can allow downloading of information to the various memory files, uploading of traffic information or operating data for archival purposes, resetting of the system after blind condition or repair and maintenance or troubleshooting the system. The installer supervisory control computer 2 can allow the ability to control the means for viewing and to input, such as by point and click means, information which may be required by the SDIP algorithms.

For example, the locations and design of each marker means along the roadways; the identification of each lane in the roadway from the intersection and for some distance out, such as up to or beyond 2000 feet; each turn lane; parking space locations; major obstructions, such as buildings, trees, utility poles, sign posts, wires and the like which can exist in the field of the means for viewing can all be inputted using the installer supervisor control computer 2.

In one or more embodiments, separate computational devices for each algorithm or subroutine can be used to provide simultaneous and parallel processing of all simplified digital image processing. Computations can be carried out to allow traffic control in real time.

In one or more embodiments, multiple means for viewing can be used that are the same or different types that can take into account different weather or time factors, such as daylight or dark. In a similar manner, multiple means for viewing can be employed to negate the effect of hills, curves, dips or other roadway obstructions.

Likewise, any suitable or conventional camera technology may be employed, such as the use of black and white, color, or grayscale video technology, or combinations thereof.

The system can be initially installed at an intersection on a new roadway or can be retrofitted to an existing intersection with relative ease and without disrupting the existing roadway bed or traffic flow. The system can be used continually or in an intermittent fashion when the CACCTTSL program determines that waiting, slowing, and stopping can be reduced or avoided when unnecessary.

In one or more embodiments, two or more intersections can be linked together to provide smooth and efficient traffic flow. Likewise, the algorithms can be modified to be controlled from a central traffic dispatch center or station using the results uploaded from several intersections to control traffic.

Figure 2:
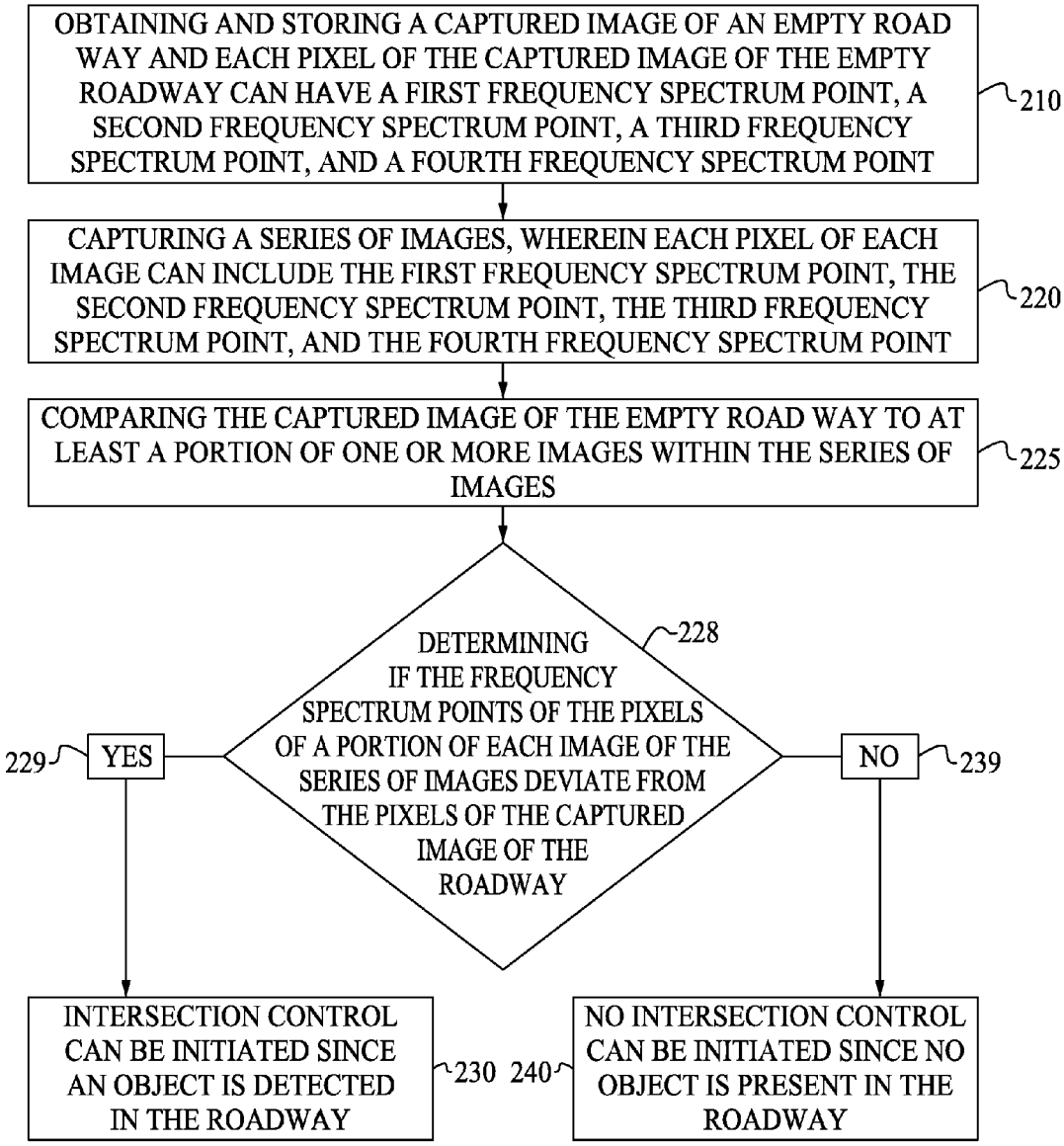
FIG. 2 is a flow diagram of the process for traffic control using a means for viewing that has four points on a frequency spectrum.

FIG. 2 is a flow diagram of the process for traffic control using a means for viewing that has 4 points of the frequency spectrum per pixel.

The process or method can include obtaining and storing a captured image of an empty road way and each pixel of the captured image of the empty roadway can have a first frequency spectrum point, a second frequency spectrum point, a third frequency spectrum point, and a fourth frequency spectrum point, as depicted in box 210. For example, each pixel of the captured image can have an infrared point, red point, blue point, and green point.

The process or method can also include capturing a series of images, wherein each pixel of each image can include the first frequency spectrum point, the second frequency spectrum point, the third frequency spectrum point, and the fourth frequency spectrum point, as depicted at box 220.

The process or method can also include comparing the captured image of the empty road way to at least a portion of one or more images within the series of images, as depicted at box 225.

The comparing of the captured image of the empty road way to at least a portion of one or more images within the series of images can include ensuring that each frequency spectrum point of one or more pixels of the captured image of the empty road way matches the frequency spectrum points of each pixel of a portion of each image of the series of images.

The process or method can include determining if the frequency spectrum points of the pixels of a portion of each image of the series of images deviate from the pixels of the captured image of the roadway, as depicted at box 228.

If yes, as depicted at box 229, intersectional control can be initiated since an object is detected in the roadway, as depicted at box 230.

If no, as depicted at box 239, no intersectional control can be initiated since no object is present in the roadway, as depicted at box 240

While these embodiments have been described with emphasis on the embodiments, it should be understood that within the scope of the appended claims, the embodiments might be practiced other than as specifically described herein.

What is claimed is:

1. A traffic control system adjacent at least two roadways in which one or more moving objects is to be controlled for efficiency and safety in a passage through an intersection of the at least two roadways in real-time, wherein the system comprises:

a. at least one means for viewing the intersection, the at least two roadways, or combinations thereof, and for capturing a series of images thereof to provide information related to movement of one or more of the objects through the intersection, the at least two roadways, or combinations thereof, wherein the means for viewing comprises a pixel having a plurality of sensors for detecting at least four points in the frequency spectrum, and wherein each image of the series of images comprises a pixel containing the at least four points in the frequency spectrum;

b. a marker means at a predetermined location for determining a location of a field of view of the means for viewing;

c. at least one digital computer means with at least one central processing unit comprising computer instructions with at least one algorithm to process less than an entire image of each image of the series of images and to compare less than the entire image of each image of the series of images to a previously captured image of the intersection, the at least two roadways, or combinations thereof, wherein the previously captured image of the intersection, the at least two roadways, or combinations thereof comprises at least one pixel containing at least four points in the frequency spectrum, wherein the intersection, the at least two roadways, or combinations thereof is unoccupied in the previously captured image, for analyzing and evaluating the information to provide location, speed, direction of travel, size and distance of one or more of the objects from the intersection;

d. parameters for one or more of the objects in order to provide the parameters as data for computer program instructions for determining the most efficient and effective protocol for allowing each moving object to enter and safely pass through the intersection for regulation of the passage through the intersection;

e. at least one algorithm to provide an appropriate control signal, wherein the at least one algorithm is selected from the group consisting of:
   (i) a first algorithm for determining atmospheric conditions for determining blindness of the means for viewing;
   (ii) a second algorithm for determining the position of the means for viewing;
   (iii) a third algorithm for selecting the previously captured image for comparison with less than the entire image of each image of the series of images;
   (iv) a fourth algorithm for selecting atypical pixels for comparison to the previously captured image and for detecting moving objects;
   (v) a fifth algorithm for identifying the atypical pixels by comparing the atypical pixels to memory files on the moving objects stored on the at least one digital computer means;
   (vi) a sixth algorithm for calculating the distance of the moving objects from the intersection;
   (vii) a computational algorithm for calculating the speed of the moving objects and for calculating the estimated time of arrival of the moving objects to the intersection;
   (viii) a seventh algorithm for determining a distance along each roadway for the means for viewing to capture images;
   (ix) an eighth algorithm for calculating an expected new location of the moving objects; and
   (x) combinations thereof;

f. a plurality of inputs in communication with the each central processing unit for receiving data from the at least one algorithm and a plurality of outputs in communication with each central processing unit for sending instructions to the means for viewing; and g. computer instructions for communicating the appropriate control signal to at least one control signal means for regulating the passage of one or more of the objects through the intersection.

2. The system of claim 1, wherein the means for viewing is a high resolution digital camera with a plurality of pixels with four optical sensors per pixel for acquiring data related to at least four points on the frequency spectrum.

3. The system of claim 2, wherein the high resolution digital camera is a video camera.

4. The system of claim 2, wherein the high resolution digital camera can pan 360 degrees horizontally, 180 degrees vertically and can zoom from 1 to 10 times with automatic focus.

5. The system of claim 1, wherein the four points on the frequency spectrum are a member of the group consisting of: ultra violate, infrared, red, blue, green, panchromatic, cyan, purple, yellow, and orange, as well as arbitrary frequencies chosen in the place of standard colors.

6. The system of claim 1, wherein the marker means is a flat, geometrically shaped marker of a fixed and precise geometry for recognition by the computer instructions with the at least one algorithm, has a highly reflective surface, is sized to be readily recognized by the means for viewing, and is capable of being viewed at night.

7. The system of claim 1, wherein each pixel contains sensors to individually detect various points on the frequency spectrum of UV, IR, and visible colors.

8. The system of claim 1, wherein the means for viewing comprises a plurality of pixels, wherein each pixel comprises at a first point on the frequency spectrum, a second point on the frequency spectrum, a third point on the frequency spectrum, and a fourth frequency spectrum, and wherein each pixel comprises a first plurality of sensors for detecting the first point on the frequency spectrum, a second plurality of sensors for detecting the second point on the frequency spectrum, a third plurality of sensors for detecting the third point on the frequency spectrum, and a fourth plurality of sensors for detecting the fourth point on the frequency spectrum.

9. The system of claim 1, wherein the at least one digital computer means employs a simplified digital image processing algorithm to process less than the entire image of each of the images captured in the series of images in order to provide data to a logical algorithm for regulation of passage of one or more of the objects through the intersection.

10. The system of claim 1, wherein the at least one control signal means is a tri-color traffic control signal.

11. The system of claim 1, further comprising a library of defective pixels maintained on the digital computer means for excluding defective pixels from use by the computer instructions with the at least one algorithm, wherein the defective pixels are pixels that have become non-responsive to light.

12. A process for regulating movement of one or more discrete bodies in motion in specific intersecting lanes and intersecting motion in real-time so that collision of such bodies in the intersection is avoided and the bodies proceed through the intersection in a safe and efficient manner, the process comprising the steps of:

a. capturing at least a portion of each image of a series of images of the discrete bodies approaching an intersectional area over a discrete period of time using a camera means having pixels with a plurality of sensors for detecting at least four points on a frequency spectrum, wherein a known marker means at a predetermined location is included in at least a portion of each image of the series of images for determining a location of a field of view of the camera means, and wherein the camera means is in communication with at least one central processing unit of at least one digital computer means to provide information related to movement of one or more of the discrete bodies;

b. using computer instructions on each central processing unit, wherein the computer instructions comprise at least one algorithm to compare each captured image of the series of images using less than the entire image to a known image of an unoccupied lane in order to determine the size, location, speed of approach to, distance from the intersection and direction of travel of at least one such discrete body in the captured image, if any, wherein the known image comprises pixels with at least four points on the frequency spectrum, and wherein the at least one algorithm is selected from the group consisting of:
   (i) a first algorithm for determining atmospheric conditions for determining blindness of the camera means;
   (ii) a second algorithm for determining a position of the camera means;
   (iii) a third algorithm for selecting the known image for comparison with less than the entire image of each captured image;

(iv) a fourth algorithm for selecting atypical pixels for comparison to the known image and for detecting discrete bodies;

(v) a fifth algorithm for identifying atypical pixels by comparing the atypical pixels to memory files on the discrete bodies stored on the at least one digital computer means;

(vi) a sixth algorithm for calculating the distance of the discrete bodies from the intersection;

(vii) a computational algorithm for calculating the speed of the discrete bodies and for estimating the time of arrival of the discrete bodies to the intersection;

(viii) a seventh algorithm for determining a distance along each intersecting lane for the camera means to capture images;

(ix) an eighth algorithm for calculating an expected new location of the discrete bodies; and (x) combinations thereof;

c. using a plurality of inputs in communication with each of the at least one central processing units to receive data from the plurality of algorithms and using a plurality of outputs in communication with each central processing unit to send signals to the camera means;

d. based on the calculated size, location, speed, distance from the intersection and direction of travel, using computer instructions on at least one central processing unit for determining the most efficient and effective protocol for allowing at least one such discrete bodies to enter and safely pass through the intersection; and e. using computer instructions on at least one central processing unit to signal a control means to operate at such a safe and efficient method for allowing one or more of the discrete bodies to pass through the intersection.

13. The process of claim 12, further comprising using a fail safe intersectional area protocol in the event that a useable image or series of images cannot be captured.

14. The process of claim 12, further comprising the step of intervening in the process at any step by an operator to manually control the intersectional control means.

15. The process of claim 12, further comprising in the step using separate computational devices for each algorithm or subroutine so that simultaneous parallel processing of all simplified digital image processing and computations is carried out allowing traffic control in real time.

16. The process of claim 12, further comprising in step maintaining a library of defective pixels on the digital computer means for excluding defective pixels from use by the computer instructions with the at least one algorithm, wherein the defective pixels are pixels that have become non-responsive to light.

* * * * *